US008721129B2

(12) United States Patent
Tseng

(10) Patent No.: US 8,721,129 B2
(45) Date of Patent: May 13, 2014

(54) LED LAMP SET FOR ENHANCING ILLUMINATION AND ELIMINATING GHOST IMAGES

(76) Inventor: Hui-Peng Tseng, Yunlin County (TW)

( * ) Notice: Subject to any disclaimer, the term of this patent is extended or adjusted under 35 U.S.C. 154(b) by 170 days.

(21) Appl. No.: 13/359,082

(22) Filed: Jan. 26, 2012

(65) Prior Publication Data

US 2013/0194812 A1 Aug. 1, 2013

(51) Int. Cl.
*F21V 5/00* (2006.01)

(52) U.S. Cl.
USPC ..... 362/311.02; 362/217.05; 362/245; 362/249.02; 362/328; 362/343

(58) Field of Classification Search
USPC ..... 362/217.05, 223, 245, 246, 249.02, 362/307, 311.02, 328, 341, 343, 545
See application file for complete search history.

(56) References Cited

U.S. PATENT DOCUMENTS 8,192,060 B2 * 6/2012 Wilkinson et al. ..... 362/311.02

FOREIGN PATENT DOCUMENTS

CN 101634425 A * 1/2010

* cited by examiner

*Primary Examiner* — Stephen F Husar
(74) *Attorney, Agent, or Firm* — Muncy, Geissler, Olds & Lowe, P.C.

(57) ABSTRACT

An LED lamp set for enhancing illumination and eliminating ghost images includes a lamp shade, a diffusion membrane and a circuit board. The lamp shade has a plurality of light cups each having a housing chamber to hold at least one LED. The housing chamber has an aperture at the bottom run through by the LED to form electric connection with the circuit board and an opening remote from the aperture to define a light output surface. The diffusion membrane covers the light output surface and is made of a transparent material and includes a plurality of transparent bumps on the surface. The circuit board is located below the lamp shade. Through the concave shape of the light cups and repetitive reflection of the bumps, light can be condensed to avoid scattering and loss. Moreover, as the light is greatly and uniformly condensed, ghost images can be eliminated.

9 Claims, 5 Drawing Sheets

LED LAMP SET FOR ENHANCING ILLUMINATION AND ELIMINATING GHOST IMAGES

FIELD OF THE INVENTION

The present invention relates to a lamp shade and particularly to an LED lamp set for enhancing illumination and eliminating ghost images.

BACKGROUND OF THE INVENTION

Conventional lamp sets are quite bulky and often need a higher socket coupled with a bowl-shaped lamp shade formed at a smaller depth. When used for a prolonged period of time a higher temperature is generated that could be hazardous. Moreover, when the conventional lamp sets are configured in multiple numbers, multiple images are generated and overlapped, they also are called ghost images. In addition, the conventional lamp sets often produce flicker illumination that easily causes fatigue of users' eyes and results in ill effect to users' vision.

Light emitting diode (LED), compared with the conventional lamp sets, adopts a different approach to receive power supply and generate light. Hence the lighting fixtures for LED cannot adopt the conventional design and require a new approach. Due to smaller size and higher illumination of the LED, the light scatters in all directions through the conventional lamp shade that could cause discomfort to users' eyes. Many methods have been proposed to remedy the aforesaid problems, such as increasing the number or illumination of the LEDs. While illumination is increased, power consumption is reduced and temperature is lowered, the problem of multiple images becomes even more severe due to light scattering. This problem must be resolved by taking into account of light refraction and reflection, and design of the lamp shade.

SUMMARY OF THE INVENTION

Therefore, the primary object of the present invention is to provide an LED lamp set for enhancing illumination and eliminating ghost images.

To achieve the foregoing object, the LED lamp set according to the invention includes a lamp shade, a diffusion membrane and a circuit board. The lamp shade has a plurality of light cups each having a housing chamber to hold at least one LED. The housing chamber has an aperture at the bottom run through by the LED to form electric connection with the circuit board and an opening remote from the aperture to define a light output surface.

The diffusion membrane provides a uniform light facing surface. It includes a substrate added with chemical particles for light scattering. When light passes through the diffusion membrane, it travels through the media with two different refraction indexes to generate refraction, reflection and scattering. Hence an optical diffusion phenomenon is formed. In addition, the diffusion membrane covers the light output surface and contains a plurality of transparent bumps to further enhance light uniform.

Thus, the invention uses the LED with high illumination and low power consumption for illumination. Through the concave shape of the light cups and repetitive reflection of the bumps, and light can be condensed to avoid scattering and loss. Moreover, as the light is greatly and uniformly condensed, the problem of ghost images can also be eliminated.

The foregoing, as well as additional objects, features and advantages of the invention will be more readily apparent from the following detailed description, which proceeds with reference to the accompanying embodiments and drawings. The embodiments serve merely for illustrative purpose and are not the limitations of the invention.

DETAILED DESCRIPTION OF THE PREFERRED EMBODIMENTS

Figure 1:
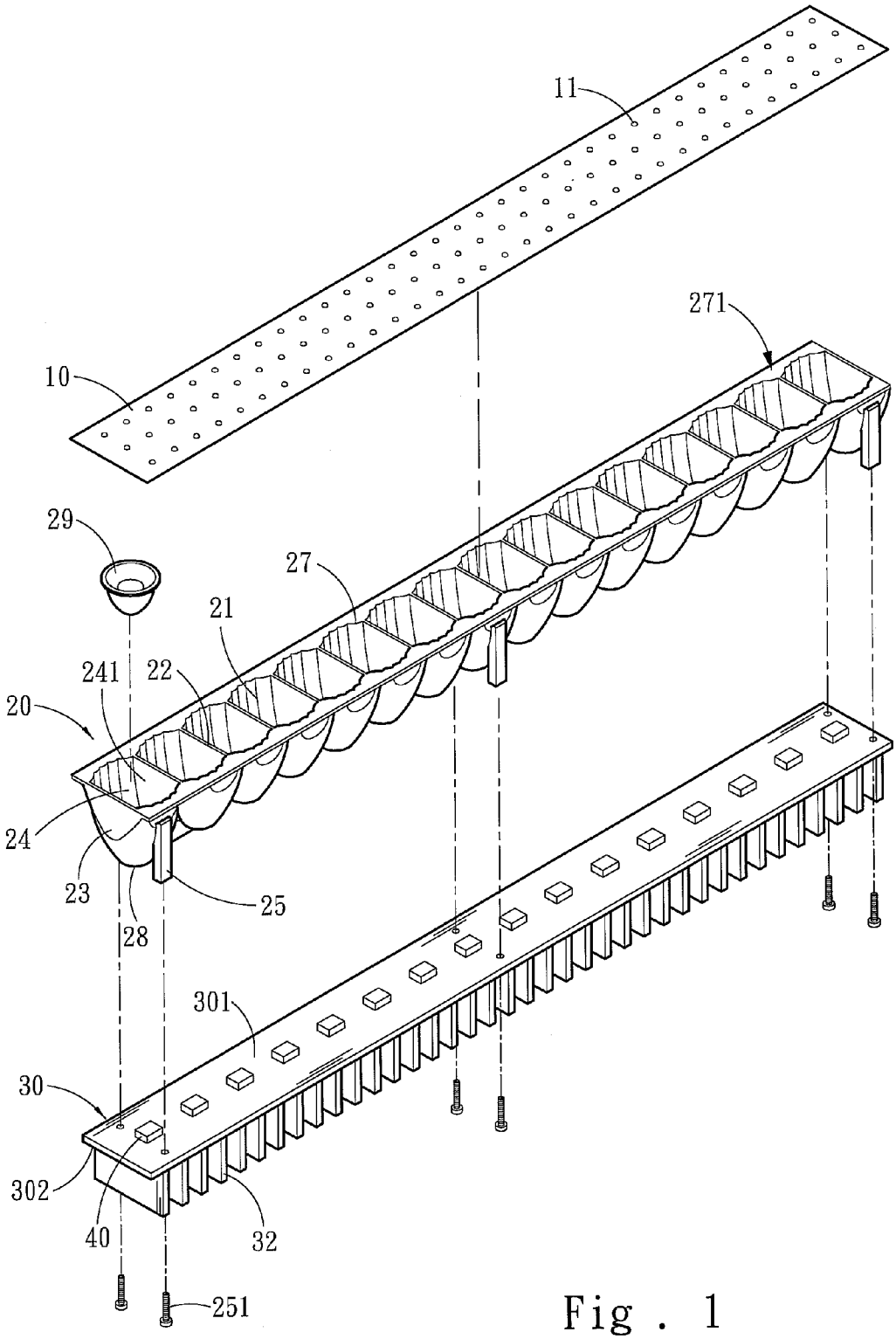
FIG. 1 is an exploded view of the invention.
Figure 2:
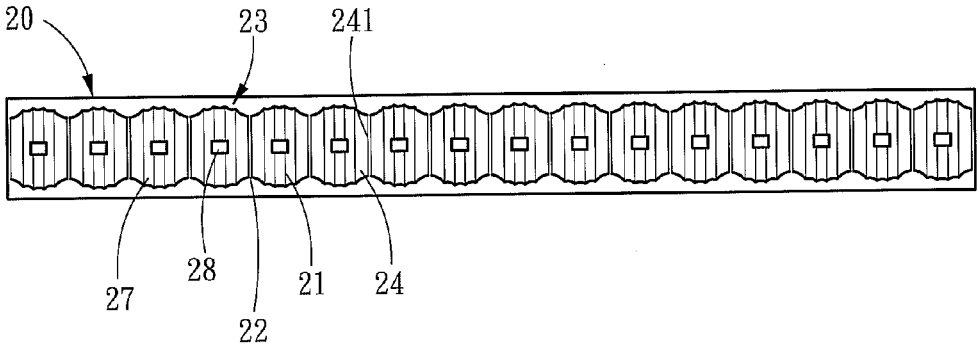
FIG. 2 is a top view of the lamp shade of the invention.
Figure 3:
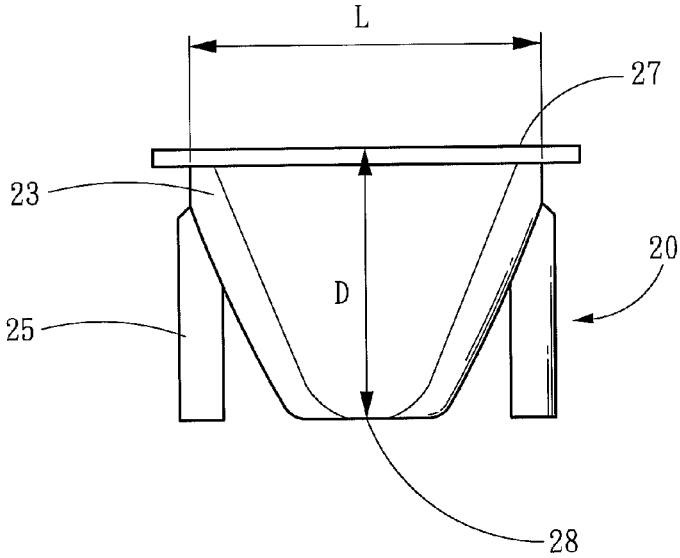
FIG. 3 is a side view of the lamp shade of the invention.
Figure 4:
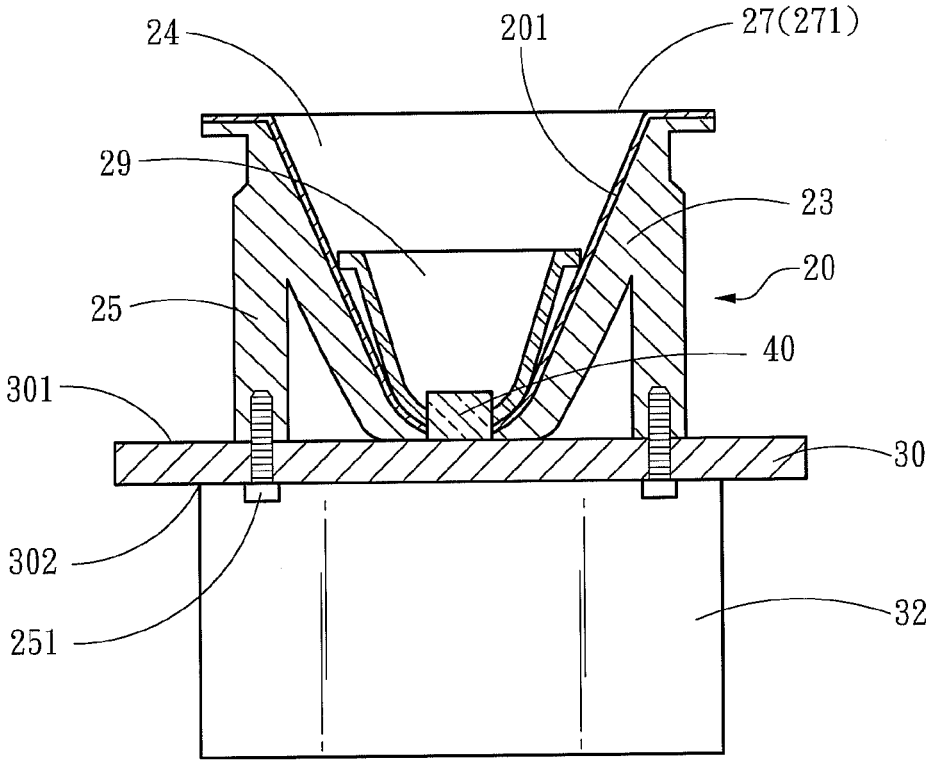
FIG. 4 is a schematic side view of the invention.

Please refer to FIGS. 1 through 4, the present invention includes a lamp shade 20, a diffusion membrane 10 and a circuit board 30. The lamp shade 20 includes a plurality of opaque reflective mirror surfaces 22 inside to reduce light scattering of abutting light sources and a plurality of light cups 23.

Each light cup 23 is formed in a concave shape and has a housing chamber 24 to hold at least one LED 40. The housing chamber 24 has an aperture 28 at the bottom run through by the LED 40 to form electric connection with the circuit board 30 and an opening 27 remote from the aperture 28 to define a light output surface 271. The opening 27 is formed at a length L equal to the distance D from the opening 27 to the aperture 28 (referring to FIG. 3) to form an optimal light travel path.

The housing chamber 24 contains a reflective surface 241 proximate the opening 27 and perpendicular to the light output surface 271. The reflective surface 241 confines the light travel path to prevent light scattering and loss.

The entire lamp shade 20 is plated with aluminum 201 in a silver-white color to increase light reflection. Hence, the reflective mirror surface 22 can reduce light scattering of the abutting LEDs, and the concave light cups 23 can enhance concentration of the light emitted from the LEDs 40. Each light cup 23 further may have a plurality of light reflection protrusive traces 21 on the wall to increase light reflection.

The diffusion membrane 10 covers the light output surface 271 to provide a uniform light facing surface. It includes a substrate added with chemical particles for light scattering. When light passes through the diffusion membrane 10, it travels through the media with two different refraction indexes to generate light diffusion effect. The diffusion membrane 10 is made of a transparent material and contains a plurality of bumps 11 which are evenly distributed and can evenly diffuse light to further reduce the light diffusion problem caused by multiple sets of light sources.

As the LED 40 provides higher illumination, cooling issue becomes more important. Hence the lamp shade 20 has a plurality of support brackets 25 on an outer side thereof that are fastened to the circuit board 30 through screws 251. The circuit board 30 has an upper surface 301 and a lower surface 302. The LED 40 is fastened to the upper surface 301. The circuit board 30 also has one set of radiation fins 32 located on the lower surface 302 connecting to the light cups 23 via the circuit board 30. Hence heat generated by the LED 40 can be channeled out quickly. The LED 40 further is encased by a transparent light condensing hood 29 to enhance illumination.

Figure 5:
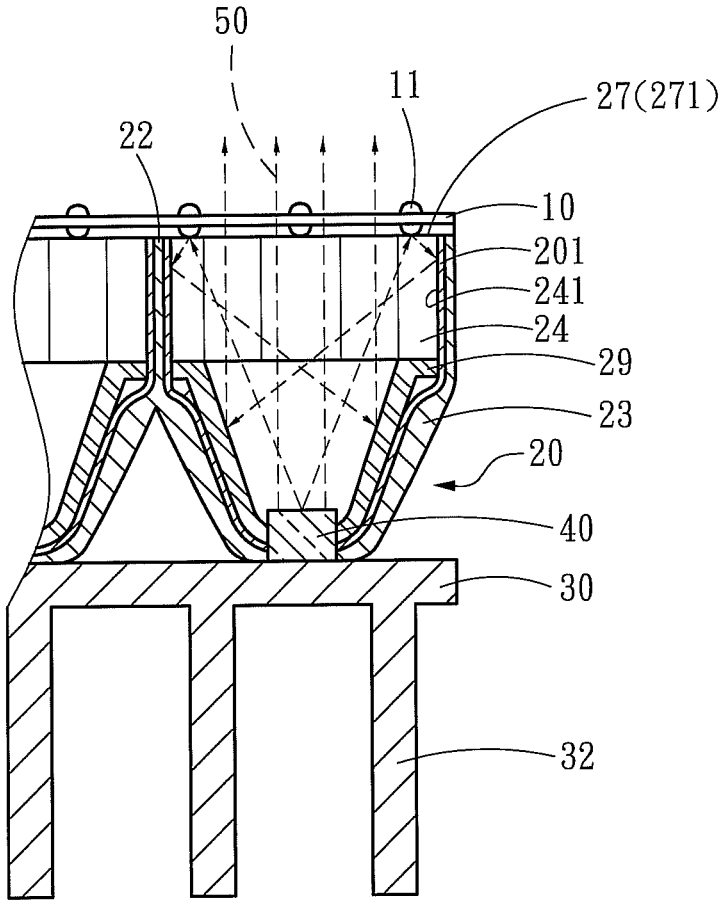
FIG. 5 is a schematic view of one embodiment of the invention showing illumination enhancing and ghost image eliminating effect.

Referring to FIG. 5, when the LED 40 emits light 50, the light 50 enters the light cup 23 and is reflected repeatedly by the transparent bumps 11, reflective mirror surface 22 and light condensing hood 29 and condensed to project towards the light output surface 271. Therefore, light condensing effect is accomplished and a uniform illumination is also realized. Through such optical reflection and refraction structure, illumination can be enhanced and ghost image can be eliminated to meet use requirements.

Figure 6:
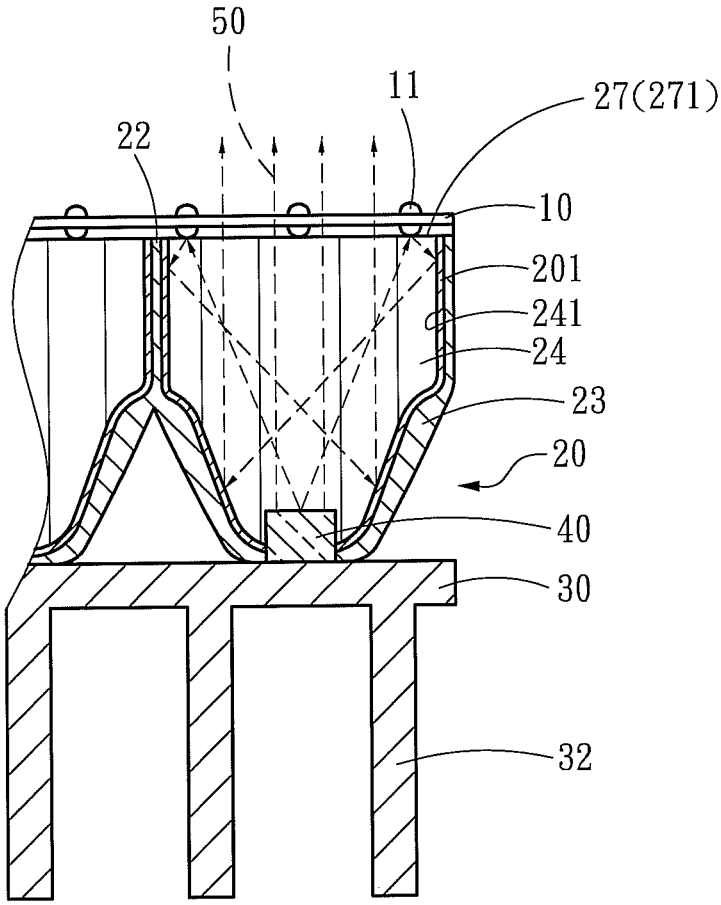
FIG. 6 is a schematic view of another embodiment of the invention showing illumination enhancing and ghost image eliminating effect.

Referring to FIG. 6, in practical use, the light condensing hood 29 can be omitted. As the light condensing hood 29 aims to control light condensing angle of the LED, even the light condensing hood 29 is omitted, the light condensing effect still can be achieved through reflection of the reflective mirror surface 22.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An LED lamp set for enhancing illumination and eliminating ghost images, comprising:

a lamp shade including a plurality of light cups each being formed in a concave shape to form a housing chamber to hold at least one light emitting diode, the housing chamber including an aperture at the bottom thereof and an opening remote from the aperture to define a light output surface;

a diffusion membrane which is located on the lamp shade to cover the light output surface and is made of a transparent material and includes a plurality of transparent bumps on the surface thereof; and a circuit board located below the lamp shade to form electric connection with the light emitting diode which runs through the aperture, wherein the opening is formed at a length equal to a distance from the opening to the aperture.

2. The LED lamp set of claim 1 further including a light condensing hood to encase the light emitting diode.

3. The LED lamp set of claim 1, wherein each light cup includes a plurality of light reflection protrusive traces inside.

4. The LED lamp set of claim 1, wherein the lamp shade includes a plurality of support brackets on an outer side thereof, each of the plurality of support brackets fastening to the circuit board through a screw.

5. The LED lamp set of claim 1, wherein the circuit board includes an upper surface connecting to the light emitting diode and a lower surface.

6. The LED lamp set of claim 5, wherein the circuit board includes one set of radiation fins on the lower surface.

7. The LED lamp set of claim 1; wherein the lamp shade is plated with aluminum.

8. The LED lamp set of claim 1, wherein the lamp shade includes a plurality of opaque reflective mirror surfaces to separate the light cups.

9. The LED lamp set of claim 1, wherein the housing chamber includes a reflective surface proximate the opening and perpendicular to the light output surface.

* * * * *